US008740056B2

(12) United States Patent
Skouboe

(10) Patent No.: US 8,740,056 B2
(45) Date of Patent: Jun. 3, 2014

(54) PARCEL BOX FOR RECEIVING AND KEEPING PARCELS IN A THEFTPROOF MANNER

(76) Inventor: Peter Skouboe, Gentofte (DK)

( * ) Notice: Subject to any disclaimer, the term of this patent is extended or adjusted under 35 U.S.C. 154(b) by 0 days.

(21) Appl. No.: 13/996,731

(22) PCT Filed: Nov. 30, 2011

(86) PCT No.: PCT/EP2011/071337

§ 371 (c)(1),
(2), (4) Date: Jun. 21, 2013

(87) PCT Pub. No.: WO2012/084433

PCT Pub. Date: Jun. 28, 2012

(65) Prior Publication Data

US 2013/0293074 A1 Nov. 7, 2013

(30) Foreign Application Priority Data

Dec. 21, 2010 (LV) ..... P-10-180

(51) Int. Cl.
*B65G 11/04* (2006.01)

(52) U.S. Cl.
USPC ..... 232/45; 232/47

(58) Field of Classification Search
USPC ..... 232/44, 47–51, 17, 45, 41 R, 42, 41 A, 232/41 D; 312/330.1, 333, 211, 212
See application file for complete search history.

(56) References Cited

U.S. PATENT DOCUMENTS 1,409,416 A 3/1922 Schuberth
1,417,773 A 5/1922 Schulze
1,558,026 A * 10/1925 Lyons ..... 232/41 R
4,460,222 A * 7/1984 Larking ..... 312/286
7,175,068 B2 * 2/2007 Fitzgibbons et al. ..... 232/31
7,913,898 B2 * 3/2011 Frankenberg et al. ..... 232/45
8,336,759 B2 * 12/2012 Skouboe ..... 232/47
8,336,760 B2 * 12/2012 Skouboe ..... 232/48

FOREIGN PATENT DOCUMENTS

| | | | |
|---|---|---|---|
| CH | 597 810 | A5 | 4/1978 |
| CN | 1 857 141 | A | 11/2006 |
| EP | 2 241 226 | A1 | 10/2010 |
| EP | 2241225 | A1 | 10/2010 |
| GB | 621 528 | A | 4/1949 |
| WO | 01/15579 | A1 | 3/2001 |
| WO | 01/93729 | A1 | 12/2001 |
| WO | 03/026466 | A1 | 4/2003 |

OTHER PUBLICATIONS

International Search Report issued in PCT/EP2011/071337 mailed on Apr. 4, 2012 (2 pages).

* cited by examiner

*Primary Examiner* — William Miller
(74) *Attorney, Agent, or Firm* — Osha Liang LLP

(57) ABSTRACT

A parcel box for receiving and keeping parcels in a theftproof manner has a box having a drawer that can be pulled out and pushed in, and a theft prevention mechanism that prevents unauthorized removal of parcel. The theft prevention mechanism has a platform configured to have parcel disposed thereon, a blocking mechanism that blocks pulling out of the drawer from the box when the parcel is placed on the platform, and an unblocking mechanism for unblocking the drawer. The drawer is swingable about a pivot axle fixed in the box. The drawer has a left side wall, a right side wall, an outer wall, and an inner wall. The platform has a first end and a second end situated opposite each other. The platform is swingable about a cross pivot axle fixed in the drawer.

12 Claims, 3 Drawing Sheets

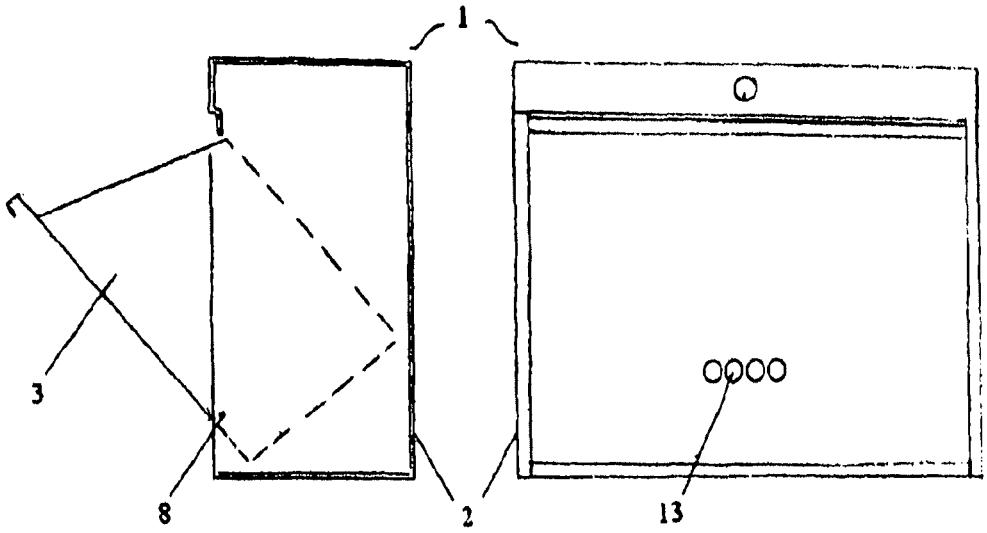
Fig. 1A
Fig. 1B
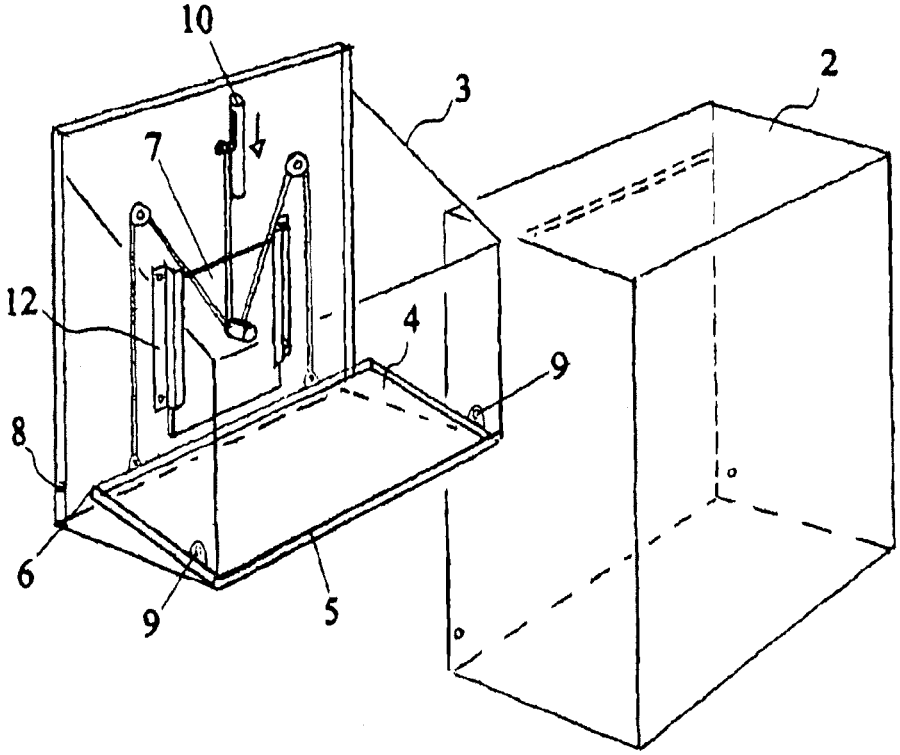
Fig. 2

PARCEL BOX FOR RECEIVING AND KEEPING PARCELS IN A THEFTPROOF MANNER

BACKGROUND OF THE INVENTION

1. Technical Field

This invention relates to apparatus for ensuring the secure delivery of mail and parcels to household or business premises. More specifically, the invention relates to parcel box for receiving and keeping parcels in a theft-proof manner.

2. Background Art

With a growing internet trade and purchase of goods online there has been an increase in the delivery of goods to the home. Since ordered goods are usually too big to fit through standard mail box, to ensure safe receipt of the ordered goods the customer is required either to be at home at the moment of delivery, or to collect these goods from a post office or seller's storehouse. Therefore there is a need in parcel box on the one part having sufficient capacity to be able to receive large-size articles, and on the other part having means preventing unauthorized removal of articles delivered in absence of addressee.

There are known parcel boxes with different types of locking mechanisms for secure delivery of parcels having a door with means for locking the door when parcel is placed in the parcel room.

Different types of locking mechanisms for parcel box are suggested in CH 597810 ("Mail box", Int. Cl.[2] A47G 29/16, publ. 14 Apr. 1978). According to invention disclosed in CH597810, it is suggested using box in the form of parallelepiped having single-swing door. The door's locking is ensured by lever with latch being put in position of locking by pushing or pulling means actuated by restoring spring and parcel placed in the parcel room. In one embodiment of the known technical solution, the parcel when being put in the parcel room pushes the plate, which actuates lever with latch locking the door of the parcel box. In the another embodiment, the weight of parcel put in the parcel room forces platform downward, which actuates lever with latch locking the door of the parcel box. The door is then unlocked by the owner's key. A major drawback of the known device is that the locking arrangement located in the inner part of the parcel box requires much space for its operation, thus limiting the usable inner area of the parcel box and the size of the parcel, which may be placed therein. Moreover, such locking arrangement contains a number of elements, which have quite short durability and thus limiting the life time of the locking arrangement.

There is known a parcel box having a single-swing door openable, when no parcel is in the box, wherein, once closed with a parcel placed in the box, the door is blocked thereby preventing unwanted removal of the parcel placed therein (WO01/15579A1 "Secure article delivery apparatus and method", Int. Cl.[7] A47G 29/14, publ. 8 Mar. 2003). When a parcel is placed in the box on a raised platform, the weight of the parcel forces the platform downwardly, against the action of biasing means such as helical or leaf springs. Once the parcel has been placed in the box, the door is closed. During the closure process the platform is lifted by cam means attached to door. As a result a dowel attached to the side of platform rises above a latch fitted to the inside face of the door as part of projection. At the moment that the door is fully closed, dowel overlies a recess formed by latch. Simultaneously, wedges line up with recesses provided in platform and the platform drops under the influence of the weight of the parcel placed thereon. Locking means such as a key operated lock attached to the side of the box prevents a lower portion of the latch from being pushed back and releasing the door. If a parcel is on the platform, the only way of opening the door is to unlock the lock which frees dowel. A major drawback of the known parcel box is that proper work of the locking arrangement depends on which part of the raised platform the parcel is placed. Also, the lifetime of the locking arrangement is limited due to using of springs and other parts which have limited work resources.

There is known a parcel box (WO/2001/93729 "Locking arrangement", Int. Cl.[7] A47G 29/20, publ. 13 Dec. 2001) with a door pivotally hinged in a casing and provided with a locking arrangement for the said door. This locking arrangement comprises a spring-loaded lock on the door with an associated strike plate on the casing, and a vertically movable support for a parcel. The vertically movable support assumes a lower position in unloaded state and an upper position in loaded state. The strike plate is pivotally mounted about a swiveling axis but has a blocking position in which at least a part of the strike plate is extending in over the blocking pawl of the spring-loaded lock when the door is closed, and is locked in the blocking position by the support when this support is in its lower position. The main drawback of the known device is that construction of its locking arrangement while being quite complicated and rather expensive, is not reliable, because different areas of the vertically movable support have different sensitivity and thus, the operation of this locking arrangement depends on which part of the vertically movable support the parcel is placed. If the parcel is placed near the back wall of the box, the bottom is not being weighed down into the locking position.

There is known a parcel box (WO/2003/026466 "A case for receiving and keeping parcels in a theftproof manner", Int. Cl.[7] A47G 29/20, publ. 3 Apr. 2003) with a door pivotally mounted on the case of the box by means of hinges and having locking arrangement with a pivotal locking lever, which is fitted between two bottoms of the parcel box, and is connected to the lower end part of the locking bar at one end and at the other end, to a swing axle extending transversally of the locking lever and rotatably journaled in the upper bottom. The swing axle is provided with projecting supporting arm which has a support base located at a distance from the swing axle, and that the support base is supporting against the lower bottom when the upper bottom is forced down towards the lower bottom by the weight of parcel placed on the upper bottom. When the parcel is weighing the movable upper bottom down towards the fixed lower bottom, the support base is made to support against the last mentioned bottom. Thereby, the supporting arm pivots the swing axle and thereby the swing arm which again pushes the locking bar up or down so that the locking arrangement is activated. The main drawback of the known parcel box is also insufficient reliability of the locking arrangement. For proper work of the case the parcel should be placed on upper bottom over transversally extending swinging axle or sufficiently close to it. In case a postman will place the parcel at a distance from the transversally extending swinging axle, the locking arrangement will not work properly.

There is known a parcel box (U.S. Pat. No. 1,417,773 "Deposit and collection receptacle", Int. Cl. A47G 19/20, publ. 30 May 1922) comprising a receptacle provided with an inwardly swinging door, a floor within the receptacle supported for swinging movement, a portion of the floor adjacent the door normally swinging downwardly by gravity, and a latch pivotally supported by said portion of the floor and normally swinging upwardly, said normally depressed portion of the floor swinging upwardly upon imposing weight upon the opposite portion of the floor, said latch holding the door against inward swinging movement when said normally depressed portion of the floor is elevated.

There is known a parcel box (EP 2241225 A1 "Parcel box for receiving and keeping parcels in a theftproof manner" Int. Cl. A47G 29/124, publ. 20 Oct. 2010) comprising a box and means preventing unauthorized removal of parcel, comprising a platform for placing parcel, means blocking opening the parcel box when parcel is placed on the platform and means for unblocking opening the parcel box. The means blocking opening the parcel box when parcel is placed on the platform comprise a blocking bracket having a first end and a second end situated opposite each other, the blocking bracket being swingable about a cross pivot axle fixed in the drawer; the platform having a first and a second end situated opposite each other, the platform being swingable about a cross pivot axle fixed in the drawer, wherein the first end of the platform is situated lower than the second end and is engaged or hingedly connected with the first end of the blocking bracket; a stop fixed in the box for engagement with the second end of the blocking bracket when parcel is placed on the second end of the platform and thereby the second end of the blocking bracket is in its lower position. Although the known parcel box is quite convenient in use, due to its size it is more appropriate for the outdoor use or use indoors if there are no strict space limitations.

Large sized parcel boxes are usually placed on the floor inside or outside of household properties. In the apartment buildings a number of parcel boxes may be put one to another. To put a parcel in the parcel box standing on the level, which is lower than the user's waist, the user has to bend down or squat. The user taking out the parcel has to perform similar operations and reach to the parcel placed deep in the parcel box. In such cases another disadvantage of the majority of the known parcel boxes is that they are quite inconvenient in use, especially when placed on the floor.

SUMMARY

A parcel box for receiving and keeping parcels in a theftproof manner according to one or more embodiments of the present invention may have one or more of the following:

- sufficient capacity to be able to receive large-sized articles,
- optimal design to be used in places with limited space,
- means preventing unauthorized removal of articles delivered in absence of addressee,
- simple, inexpensive, reliable and easy-to-use construction, as well as is convenient in use, especially when fixed to a wall one over another or placed on the level, which is lower than its owner's waist.

A parcel box according to one or more embodiments of the present invention comprising a box, a drawer which is swingable about a pivot axle fixed in the box and thus can be pulled out and pushed in and means preventing unauthorized removal of parcel, comprising a platform for placing parcel, means blocking pulling out of the drawer from the box when parcel is placed on the platform and means for unblocking opening the parcel box drawer. The means blocking pulling out of the drawer from the box when parcel is placed on the platform comprise:

- the platform having a first and a second end situated opposite each other, the platform being swingable about a cross pivot axle fixed in the drawer and being provided with a counterbalance or connected to the counterbalance, so that the first end of the platform is situated lower than the second end when there is no parcel on the platform,
- a lock being operably connected with the counterbalance, such that when there is no parcel on the platform, the counterbalance is holding the lock open, but when the parcel is being put on the platform, outweighing the counterbalance and moving the second end of the platform into its lower position, the lock is being released to be able to hold the drawer in closed position,
- a stop fixed in the box for engagement with the lock when parcel is placed on the platform and the lock is being released.

According to one or more embodiments of the present invention, use of the drawer ensures the convenience in use of the parcel box, especially when placed on the level, which is lower than its owner's waist or fixed to a wall one over another. The construction of a drawer which is swingable about a pivot axle fixed in the box allows using the offered parcel box in places having strict space limitations.

The means for preventing unauthorized removal of parcel according to one or more embodiments of the present invention have simple, inexpensive, reliable and easy-to-use construction; they are sufficiently sensitive to react on lightweight parcel, regardless on which part of the platform the parcel is placed. However weight sensitivity of the parcel box can also be adjusted, according to needs. The offered means for preventing unauthorized removal of parcel allow using simple mechanism of the means for signaling the presence of the parcel in the parcel box. Also, the suggested means for preventing unauthorized removal of parcel have longer lifetime if compared with the most of prior art technical solutions.

Various embodiments of the present invention are described by way of examples with references to the drawings.

BRIEF DESCRIPTION OF DRAWINGS

FIG. 1A represents a schematic cross section side view of a parcel box; FIG. 1B represents a frontal view of the parcel box;

FIG. 2 represents a schematic view of a drawer and means blocking opening the parcel box in position when there is no parcel in the drawer;

DETAILED DESCRIPTION

Embodiments of the invention are described below with reference to the drawings. In embodiments of the invention, numerous specific details are set forth in order to provide a more thorough understanding of the invention. However, it will be apparent to one of ordinary skill in the art that the invention may be practiced without these specific details. In other instances, well-known features have not been described in detail to avoid obscuring the invention.

Figure 3:
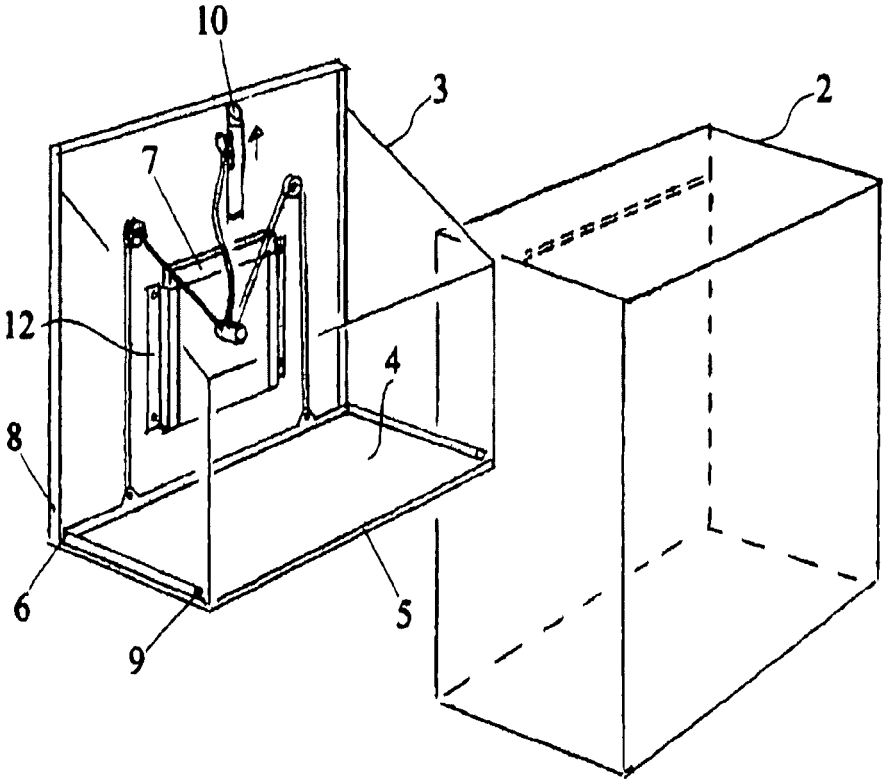
FIG. 3 represents a schematic view of the drawer and the means blocking opening the parcel box in position when there is parcel in the drawer.
Figure 4:
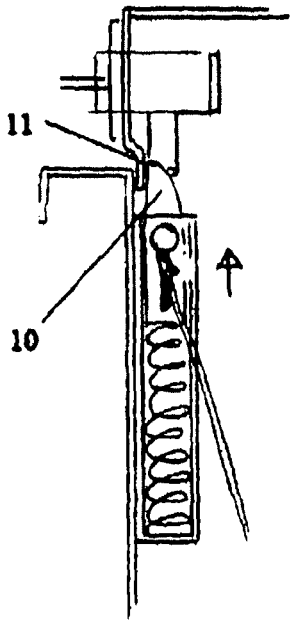
FIG. 4 represents side view of a lock and a stop in engaged position (when parcel is inside)
Figure 5:
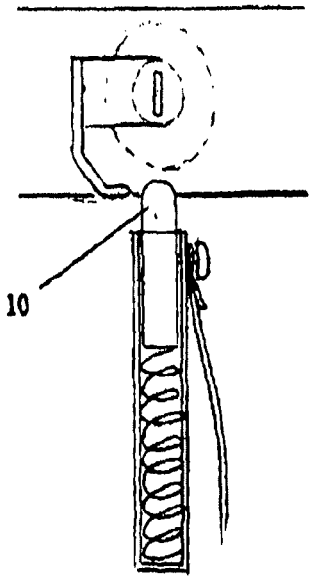
FIG. 5 represents a frontal view of the lock in engaged position with the stop (when the parcel is inside)
Figure 6:
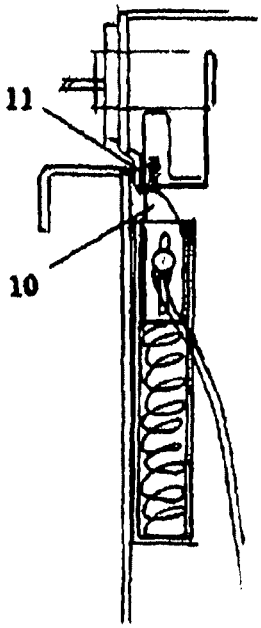
FIG. 6 represents side view of a lock and a stop in disengaged position; the lock being disengaged by turning the user's key.
Figure 7:
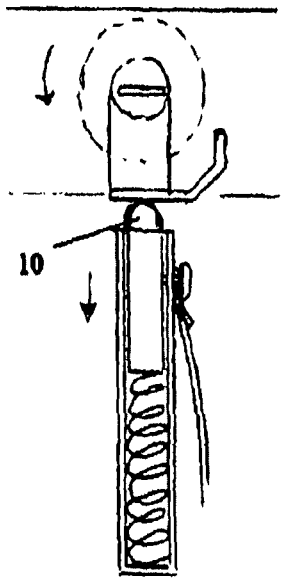
FIG. 7 represents a frontal view of the lock in disengaged position with the stop.

Parcel box 1 for receiving and keeping parcels in a theftproof manner comprises a box 2 and a drawer 3 (FIGS. 1A and 1B). The drawer 3 comprises a platform 4 having a first 5 and a second 6 end situated opposite each other (FIGS. 2 and 3). According to one embodiment the second end 6 is connected to a weight (counterbalance) 7 being mounted in the drawer 3 (FIG. 2-3); according to another embodiment, the first end 5 is provided with the weight 7. The drawer 3 comprises left and right side walls, outer wall and inner wall. The drawer 3 being swingable about a pivot axle 8 fixed (according to one or more embodiments of the present invention, releasably fixed) in the box 2; alternatively, the drawer 3 is being swingable about two coaxial pivot axles 8 being symmetrically (optionally releasably) mounted in the left and right side walls of the box 2, or the drawer 3, or in the left and right butts of the drawer's (3) outer wall. The platform 4 is swingable about a cross pivot axle 9 or two coaxial pivot axles 9 fixed in the drawer 3. The axle or coaxial axles 9 are placed in parallel to imaginary line dividing the first end 5 of the platform 4 from its second end 6. The first end 5 of the platform 4 is situated lower than the second end 6. The first end 5 according to one or more embodiments of the present invention is shorter than the second end 6. In one embodiment the second end 6 is kept in its upper position by the weight 7 using means for connecting the weight 7 with the platform 4, while in another embodiment the first end 5 is forced down by the weight 7 thereby the second end 6 is situated higher than the first end 5. The box 1 according to one or more embodiments of the present invention also comprising a lock 10 (e.g. spring latch lock) or equivalent means, mounted in the drawer 3 and a stop 11 fixed in the box 2 and adapted for engagement with the lock 10. The lock 10 being operably connected with the counterbalance 7, such that when there is no parcel on the platform 4, the counterbalance 7 is holding the lock 10 in its open position, but when the parcel is being put on the platform 4, outweighing the counterbalance 7 and moving the second end 6 into its lower position, the lock 10 is being released to be able to engage with the stop 11 and hold the drawer 3 in closed position. According to one or more embodiments of the present invention, the means for unblocking opening of the parcel box 1 comprise means for disengagement of the lock 10 from the stop 11 (FIG. 4-7). The means for disengagement of the lock 10 from the stop 11 may comprise a claw being fixed to a wafer tumbler lock such that rotation of a key in the wafer tumbler lock would cause rotation of the claw and pressing the latch of the spring latch lock by the claw (FIGS. 5 and 7). For the skilled person it is obvious that other embodiments are also possible. According to one or more embodiments of the present invention, the counterbalance 7 is being put in a guiding means 12, being fixed in the drawer 3.

Also, the drawer 3 may contain a signaling device comprising signaling means in the form of one or more apertures 13 in the outer wall of the drawer 3, the counterbalance 7 mounted so as to allow its vertical sliding translational movement along the said outer wall of the drawer 3, the said counterbalance 7 being provided by color label, or equivalent indicating means allowing to distinguish between the upper and lower position of the counterbalance, wherein the said color label, or equivalent indicating means are placed, so that one respective indicating means is visible through the said aperture or apertures 13 in the outer wall of the drawer 3.

The parcel boxes may either be mounted on the wall of a building, placed on the floor and put one on top another, or be in the form of a cabinet. The parcel box 1 may be combined with a mail box, e.g. being mounted on an upper part (wall) of the parcel box; in this particular embodiment the parcel box 1 may have a cut (another letter opening) in the upper wall being closed by a releasably mounted plate, so that the plate can be opened or removed; opening or removing of the plate allows increasing the space of the mail box. The parcel box 1 may be provided with means for blocking or keeping the second end 6 of the platform 4 in its lower position, thus blocking opening of the parcel box 1. For instance, opening of the parcel box 1 can be blocked by putting the plate on the platform 4, or locking the lock 10. That is especially convenient during long-time absence of user, which is connected with accumulation of large number of mail. Thus, using the suggested construction allows increasing the space of the mail box and simultaneously blocking pulling out of the drawer from the box preventing unauthorized access to the mail.

In a "waiting position", i.e. when there is no parcel on the platform 4, the weight 7 outweighs the first end 5 of the platform 4 (keeps the second end 6 in its upper position). In this position, the weight 7 holds the lock 10 in its open (disengaged) position. In this position the drawer 3 can be pulled out and pushed in again and again. When the parcel is delivered, the courier pulls out the drawer 3, puts the parcel on the platform 4. Being forced down by the weight of parcel, the second end 6 of the platform 4 goes down, thus pulling down the means for connecting the weight 7 with the platform 4 and moving the weight 7 up. Pushing the drawer 3 into the box 2 changes the direction of application of the force of gravity to the parcel and platform 4 helping the upper end of the platform 4 to go down. As a result, the weight 7 frees the lock 10. As soon, as the drawer 3 is pushed into the box 2, the lock 10 engages with the stop 11 and holds the drawer 3 in closed position-blocks pulling it out from the box.

To unlock the parcel box 1, the user inserts the key into the wafer tumbler lock and turns the key thereby disengaging the lock 10 from the stop 11. When the lock 10 is disengaged from the stop 11, the drawer 3 can be pulled out from the box 2 giving the user access to the parcel.

If the parcel box is equipped with the signaling device the user can see whether there is a parcel in the parcel box from a distance. When there is no parcel in the parcel box 1, the signaling device is set to position "empty", which may be marked by green color. When the parcel is placed on the second end 6 of the platform 4, the weight 7 being forced by the weight of the parcel goes up along the outer wall of the drawer 3, showing another marking (e.g. green) through the aperture or apertures 13 in the outer wall of the drawer 3, signaling that there is parcel inside.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

The invention claimed is:

1. A parcel box for receiving and keeping parcels in a theftproof manner, comprising:

a box comprising a drawer that is configured to be pulled out and pushed in; and a theft prevention mechanism that prevents unauthorized removal of parcel, wherein the theft prevention mechanism comprises:

a platform configured to have parcel disposed thereon, a blocking mechanism that blocks pulling out of the drawer from the box when the parcel is placed on the platform, and an unblocking mechanism for unblocking the drawer, wherein the drawer is swingable about a first pivot axle fixed in the box, wherein the drawer comprises a left side wall, a right side wall, an outer wall, and an inner wall, wherein the platform comprises a first end and a second end situated opposite each other, wherein the platform is swingable about a first cross pivot axle fixed in the drawer, wherein the platform is provided with a counterbalance or connected to the counterbalance by a connecting mechanism that connects the counterbalance with the platform, so that the first end of the platform is situated lower than the second end when there is no parcel on the platform, wherein the counterbalance is mounted so as to allow vertical sliding translational movement thereof along the outer wall of the drawer, wherein the blocking mechanism comprises:

a lock that is operably connected with the counterbalance, such that when there is no parcel on the platform, the counterbalance holds the lock open, while when the parcel is disposed on the platform, the parcel outweighs the counterbalance and moves the second end into a lower position, and the lock is released to hold the drawer in a closed position, and a stop fixed in the box for engagement with the lock when the parcel is placed on the platform and the lock is released.

2. The parcel box according to claim 1, wherein the counterbalance is put in a guide, being fixed in the drawer.

3. The parcel box according to claim 1, wherein the unblocking mechanism comprises a disengagement mechanism that is configured to disengage the lock from the stop.

4. The parcel box according to claim 1, wherein the drawer is swingable about the first pivot axle and a second pivot axle that is coaxial with the first pivot axle, wherein the first pivot axle and the second pivot axle are symmetrically mounted in the left and right side walls of the box, the drawer, or in left and right butts of the outer wall of the drawer.

5. The parcel box according to claim 4, wherein the first and second pivot axles are releasably fixed.

6. The parcel box according to claim 1, wherein the first pivot axle is releasably fixed.

7. The parcel box according to claim 1, wherein the platform is swingable about the first cross pivot axle and a second cross pivot axle that is symmetrically mounted coaxially with respect to the first cross pivot axle.

8. The parcel box according to claim 1, wherein the drawer comprises a signaling device provided by color label, notch or cut off on peripheral or outer part thereof allowing a user to distinguish between empty and parcel inside positions.

9. The parcel box according to claim 8, wherein the signaling device comprises at least one aperture in the outer wall of the drawer, wherein the counterbalance is mounted so as to allow sliding translational movement along the outer wall of the drawer, wherein the counterbalance is provided with an indicator allowing a user to distinguish between the upper and lower position of the counterbalance, wherein the indicator is to be visible through the aperture or apertures in the outer wall of the drawer.

10. The parcel box according to claim 9, wherein the indicator is a color label.

11. The device according to claim 1, wherein the parcel box is provided with means for blocking or keeping the second end of the platform in a lower position thereof, thus blocking opening of the parcel box.

12. A parcel box for receiving and keeping parcels in a theftproof manner, comprising:

a box comprising a drawer that is configured to be pulled out and pushed in; and a theft prevention mechanism that prevents unauthorized removal of parcel, wherein the theft prevention mechanism comprises:

a platform configured to have parcel disposed thereon, a blocking mechanism that blocks pulling out of the drawer from the box when the parcel is placed on the platform, and an unblocking mechanism for unblocking the drawer, wherein the drawer is swingable with respect to the box, wherein the drawer comprises a left side wall, a right side wall, an outer wall, and an inner wall, wherein the platform comprises a first end and a second end situated opposite each other, wherein the platform is swingable with respect to the drawer, wherein the platform is provided with a counterbalance or connected to the counterbalance by a connecting mechanism that connects the counterbalance with the platform, so that the first end of the platform is situated lower than the second end when there is no parcel on the platform, wherein the counterbalance is mounted so as to allow vertical sliding translational movement thereof along the outer wall of the drawer, wherein the blocking mechanism comprises:

a lock that is operably connected with the counterbalance, such that when there is no parcel on the platform, the counterbalance holds the lock open, while when the parcel is disposed on the platform, the parcel outweighs the counterbalance and moves the second end into a lower position, and the lock is released to hold the drawer in a closed position, and a stop fixed in the box for engagement with the lock when the parcel is placed on the platform and the lock is released.

* * * * *